United States Patent [19]

Kurtz

[11] Patent Number: 5,074,189

[45] Date of Patent: Dec. 24, 1991

[54] ELECTRICALLY-FIRED AND MAGNETICALLY ACTUATED FIREARM

[75] Inventor: Earl F. Kurtz, Lafayette, Colo.

[73] Assignee: Legend Ammunition, Inc., Las Vegas, Nev.

[21] Appl. No.: 456,988

[22] Filed: Dec. 22, 1989

[51] Int. Cl.[5] ..... F41A 5/20; F41A 9/24; F41A 17/06; F41A 19/58

[52] U.S. Cl. ..... 89/135; 42/50; 89/161; 89/177

[58] Field of Search ..... 42/10, 11, 50, 84; 89/28.05, 135, 161, 177, 178

[56] References Cited

U.S. PATENT DOCUMENTS

| | | | |
|---|---|---|---|
| 3,580,113 | 5/1971 | Ramsay et al. | 42/84 |
| 4,440,063 | 4/1984 | Zangrando | 89/135 |
| 4,563,828 | 1/1986 | Kriegeskorte | 42/84 |
| 4,757,629 | 7/1988 | Austin | 42/84 |

FOREIGN PATENT DOCUMENTS

| | | | |
|---|---|---|---|
| 131016 | 8/1919 | United Kingdom | 89/161 |

*Primary Examiner*—Stephen C. Bentley

*Attorney, Agent, or Firm*—Donald W. Margolis; Emery L. Tracy

[57] ABSTRACT

An electrically-fired cartridgeless ammunition projectile firearm system, which can operate with or without batteries, and which system has only one moving part is provided. The firearm system uses magnets to generate the charges which are required to detonate the projectiles, uses opposing magnets to eliminate the need for the inclusion of recoil springs after firing, and also uses magnets to dampen the recoil of the firearm. Additionally, it provides a firearm system, which, when loaded with a magazine and ready to fire, operates with no external openings with the exception of the muzzle and cooling slots surrounding the firing chamber, so that it can operate under almost any physical or climatic conditions. It is also designed to utilize a forward motion of its barrel on firing, which reduces the amount of recoil felt by the user. The several factors which reduce recoil, improves accuracy. It is simple in construction, design and operation, thereby providing a great reduction in production costs and in training requirements, even for operators having no firearm experience.

12 Claims, 3 Drawing Sheets

ELECTRICALLY-FIRED AND MAGNETICALLY ACTUATED FIREARM

BACKGROUND OF THE INVENTION:

(a) Field of the Invention

This invention relates to an electrically fired firearm having a forwardly movable barrel, and which also has an electrically controlled firing device in which electric charges are generated electromagnetically within the weapon In one mode, the firearm includes a projectile magazine which includes magnets which serve to feed projectiles into the firing chamber.

(b) Discussion of the Prior Art

It is well known that the combination of ejectable cartridge cases of metal or paper which were used with breech-loaded guns earlier in history have experienced many difficulties in the making and shooting of firearms These difficulties include the extra weight and cost of the loads, the time involved between the firing of rounds within the firearm, the complicated structure required of these firearms, and even the jamming of the weapon during semi-automatic and automatic firing. Present breech-loading firearms are much simpler and less costly in design than their predecessors, but they still contain many of the same defects because of their inherent design Of perhaps greatest interest to the present invention is U.S Pat. No. 4,440,063 which discloses a firing device utilizing the kinetic energy of a gas operated gun to generate, store and discharge voltage to fire electrically primed ammunition. The device uses rearward movement of coils relative to magnets to charge a capacitor, and then discharges the capacitor to fire the firearm. It does not utilize gas pressure to move the magnets, nor does it disclose a forward recoil, nor the use of magnets to dampen the recoil of the firearm and to return the portion of the weapon which has recoiled to its original position. To the extent that it utilizes a magazine, the magazine is spring operated.

Other prior art which discloses electrically fired firearms include U.S. Pat. No. 4,757,629 which shows the use of a magnet to replace the coil spring behind the firing pin, and U.S. Pat. No. 4,563,828 which shows the use of capacitors to deliver a high voltage to heat the powder in a conventional projectile to ignition temperature.

It is thus seen that it would be desirable to have an electrically fired firearm which utilizes cartridgeless ammunition and eliminates the need for extractor and ejection ports on the firearm, which does not utilize gas pressure to move the electric generating coils, which eliminates the need for springs throughout the firearm, which utilizes a forward recoil feature, which uses magnets to generate voltage and to dampen and reduce the recoil of the firearm and by thus reducing recoil improves accuracy, which uses opposing magnets to replace springs in the magazine, which is simple in design and manufacture, and which is lighter in total weight than conventional firearms.

SUMMARY OF THE INVENTION

In view of the foregoing, it is an object of the present invention to provide a weapon which is electrically-fired, without the need of batteries, and magnetically actuated firearm system which has only one moving part, and which can eliminate the need for the inclusion of springs.

It is another object of the present invention to provide such a firearm system which is capable of using cartridgeless ammunition, and which, by the use of cartridgeless ammunition can eliminate substantial ammunition costs for the user.

It is another object of the present invention to provide a firearm which, when loaded and ready to fire, operates with no external openings, with the exception of the muzzle and cooling slots surrounding the firing chamber.

It is another object of the present invention to provide a firearm which uses magnets to generate voltage and to dampen the recoil of the firearm and by thus reducing recoil improves accuracy, which uses opposing magnets to provide recoil of the barrel after firing.

It is another object of the present invention to provide a firearm which, because it has no springs, limited openings, and only one moving part, it can operate under almost any physical or climatic conditions, including extended burial followed by only shaking it out or washing it out, or submersion in water with both substantially no adverse effects.

It is another object of the present invention to provide a field weapon, which due to the elimination of the need for a heavy operating bolt and/or slide, of the type which is common to contemporary field weapon designs, achieves great reduction in overall weight of the weapon, thereby making it easier to carry and easier to operate, and which thereby also offers a great reduction in the amount of recoil felt by the user, and by thus reducing recoil improves accuracy.

It is another object of the present invention to provide a firearm which is designed to utilize a forward motion of its barrel on firing, to further reduce the amount of recoil felt by the user and thereby improve firing accuracy.

It is another object of the present invention to provide a firearm which is simple in construction, design and operation, thereby providing a great reduction in production costs and in training requirements, even for operators having no firearm experience.

It is another object of the present invention to provide a weapon, which because of its simplicity of design, offers a simple weapon which can be inexpensive and cost effective to produce, and which has components which are both easy to clean or replace, and for which replacement parts are low in cost.

It is another object of the present invention to provide a weapon which has the ability to fire a projectile at higher velocity than can be attained with similarly sized weapons using contemporary metallic cartridges.

The foregoing objects of the present invention are obtained by providing a firearm having a barrel mounted within a shroud for forward and backward movement. The moveable barrel includes a front or muzzle end and a rear end, an axial centerline, and gas ports near the muzzle. Upon firing, the gas ports allow the expanding gases which result from the ignition of the chemicals in the rear portion of the projectile, to pass through the ports and impact upon a deflector plate. The impact of the gases upon the deflector plate causes the barrel to be initially blown forward as far as a pre-set stop position, followed by a rearward recoil of the barrel caused by magnetic repulsion or springs, as detailed below.

Enclosed within and supported by the shroud is a stationary firing chamber. The firing chamber is normally in gas tight contact with the rear end of the barrel in a manner which allows the firing chamber and the barrel to separate from one another in response to the gas driven blow forward motion of the barrel during firing, and to then reconnect with one another after the barrel recoils and returns to its normal position to once again form a gas tight seal with firing chamber 14. Also enclosed within the shroud and in combination with one another is a stationary chamber. The stationary chamber is located outside of the barrel and also outside of the firing chamber, normally above the barrel and firing chamber. One or more stationary field coil is located within the stationary chamber in axial alignment with, but spaced from the centerline of the barrel. A stationary magnet is attached directly to the shroud within the stationary chamber in close proximity to the front end of each field coil.

At least one magnet is also fixedly attached to the moveable barrel in close proximity to the rear end of each stationary field coil within the stationary chamber. The body of each magnet which is attached to the top of the moveable barrel, including its poles, are axially aligned with, but spaced from the centerline of the barrel. Each magnet which is carried by the barrel is located, positioned and designed in such a manner that they can and will move forward and then backward either through or in close proximity to its associated stationary field coil when the barrel moves forward in response to the gas driven blow forward motion and recoil of the barrel during firing, and then backward during the recoil of the barrel. This forward and backward movement of each magnet which is attached to the barrel in proximity to its associated field coil generates an electric charge within that coil. The charge thus generated is rectified, for example by a diode, so that the different charge generated by each direction of motion of the magnets, the charge which enters the storage element is always of the same character. As detailed below, this electric charge conducted to and stored within the firearm, and is then available to fire another projectile.

The stationary magnets carried by the shroud and the movable magnets carried by the barrel are all preferably permanent magnets, although, in certain embodiments electromagnets may be used. While the stationary magnets carried by the shroud and the movable magnets carried by the barrel are all substantially aligned with one another and have their poles aligned, their polarity is reversed. That is, for example, if each stationary magnet carried by the shroud has its front and rear poles aligned south to north, respectively, then the movable permanent magnet carried by the barrel has its front and rear poles aligned in the reverse order, that is, for example, north to south respectively. This will result in the north pole of the magnet which is carried by the barrel being driven into proximity to the north pole of the magnet which is secured to the shroud when the barrel is caused to blow forward. However, since like magnetic poles repel each other, after the blow forward force is expended, there is a magnetically induced rearward movement of the magnets carried by the barrel, and, concomitantly also of the associated barrel. Therefore, as is detailed below, the need for operating springs to return the barrel to its original position after firing is optional. In preferred embodiments the magnets carried by the barrel are crescent or semi-torroidal shaped, the field coils are semicircular or zig-zag shaped with a diameter at least slightly greater than the diameter of the magnets carried by the barrel. The field coils thereby define a substantially crescent shaped open path which will allow each crescent or semi-torroidal shaped magnet to pass forward and then backward through its associated coil to generate an electric charge.

The weapon of the present invention is designed to utilize a cartridgeless form of self contained electrically ignited projectile ammunition. The projectile is described in greater detail in U.S. Pat. application Ser. No. 07/455754, filed simultaneously herewith. An electromechanical system is provided in association with the weapon of the present invention for electrically igniting a combustible priming wafer and the associated projectile propellant to fire a projectile. The system includes what may appear to be a standard trigger assembly, but which is really a switch, a safety and selector switch connected to a micro-processor to select various firing sequences, a capacitor or the like, a control circuit, and an ignition electrode which ignites projectile propellant through the use of a combustible priming wafer. The capacitor is positioned and designed to discharge electricity to the electrode, and thence to an electrically ignited cartridgeless projectile in response to the control circuit, as detailed below. The storage device stores the electric charges which are generated when the magnets which are carried by the barrel move in proximity to the field coil. The control circuit is activated by the trigger switch to initiate discharge of the capacitor. The trigger assembly and safety switch, will normally be securely attached to the shroud, while the control circuit, capacitor, and ignition electrode will normally be within the shroud, closely adjacent to the firing chamber.

As detailed below, in preferred embodiments a projectile magazine is associated with the firearm system. The magazine includes a plurality of opposed magnets which are located within the magazine in a manner which supplies the necessary force to feed projectiles from the magazine and into the breech of the firearm.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figures 1, 6, 7:
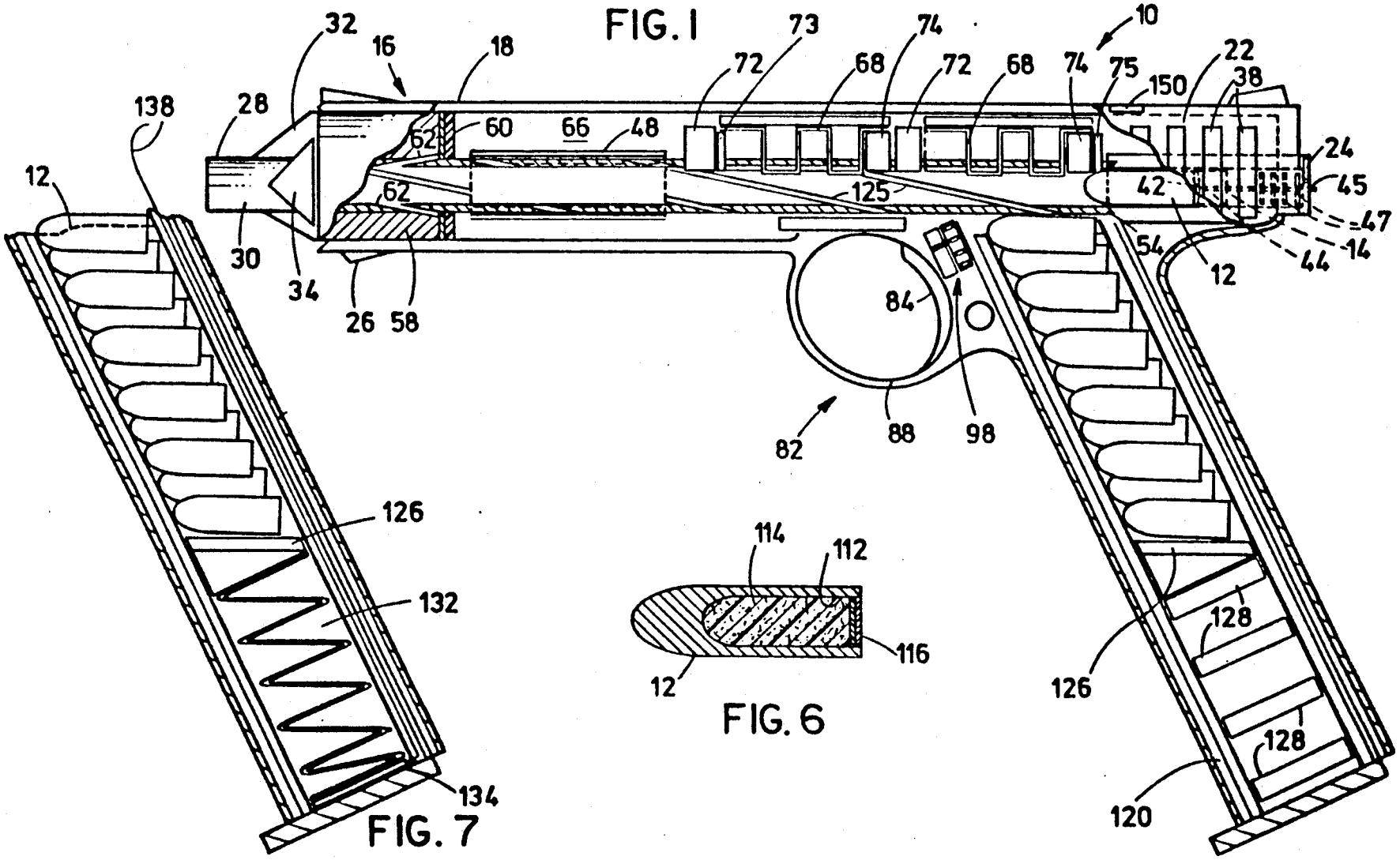
FIG. 1 is an elevational view, partially in cross-section and with parts broken away of an electrically-fired and magnetically actuated firearm, according to the present invention, with the barrel in its normal position and showing a projectile in the firing chamber and other projectiles in a magnetically actuated magazine.
FIG. 6 is a schematic cross-sectional representation of one preferred form of cartridgeless, electrically ignitable projectile which may be used with the firearm of the present invention.
FIG. 7 is a side elevational view, partially in crosssection, showing the details of an alternative form of ammunition magazine using a conventional spring driven mechanism for use with the weapon of the present invention, which magazine carries a battery for use in igniting the electrically ignitable projectiles carried by the magazine.

Referring to FIG. 1, in which there is shown an elevational view, partially in cross-section and with parts broken away of a firearm in the form of pistol, generally 10, having a projectile 12 in its firing chamber 14. The entire firearm 10 is encased in a shroud, generally 16, of conventional pistol shape, although, the novel features of the present invention may be utilized in any form of weapon, including, but not limited to pistols, carbines, rifles, sub-machine guns, cannons, and the like. In the embodiment shown, shroud 16 is split lengthwise from the top to the bottom thereby having a right half 18 and a left half 22. Right half 18 and left half 22 are connected at their butt ends by an external hinge 24. A catch 26 is located near the muzzle 28 of barrel 30, while a muzzle flange 32 is connected to muzzle 28 of barrel 30. Cocking knobs 34 are shown located on the side of muzzle flange 32, and preferably on both sides of muzzle flange 32. As detailed below, cocking knobs 34 can be used to push barrel 30 forward to load and actuate the weapon. The location of cocking knobs 34 may be varied. In preferred embodiments a frame, not shown separately, is located and bonded into right half 18 of shroud 16. All connected internal parts of weapon 10, as described in greater detail below, are fitted into right half 18 thereof, while left side 22 of shroud 16 serves as a cover which will lie on the right when weapon 10 is opened at hinge 24.

Stationary firing chamber 14 is located within shroud 16 near the rear of weapon 10. While not clearly visible, the internal base of firing chamber 14 is in the form of a parabolic curve and the internal surface of firing chamber 14 is smooth hard material such as, for example, chrome plated steel or ceramic. This parabolic curvature of firing chamber 14, combined with its smooth surface, provides a method of self cleaning of the of residue from the chamber in response to the vacuum formed by projectile 12 as it exits the muzzle of the weapon. Other mechanisms for cleaning chamber 14, and for ejecting projectiles 12 from chamber 14 are set forth below. The external surface of firing chamber 14 carries cooling fins not shown, in order to expedite cooling via vertical cooling slots 38 which are carried in both sides of shroud 16 adjacent to stationary firing chamber 14.

Figure 5:
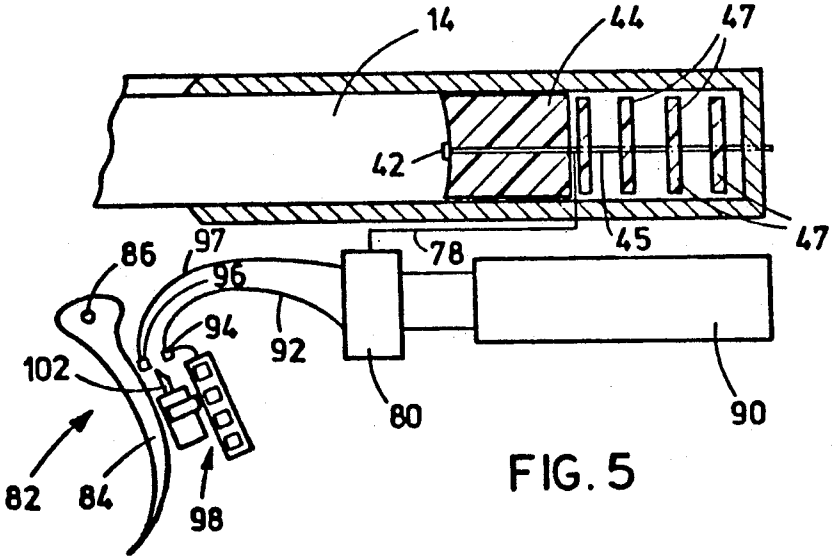
FIG. 5 is an enlarged semi-schematic side elavational view showing additional details of the firing chamber and ignition electrode system, and a schematic representation of the electronic firing mechanism, control unit and charge storage unit.

As shown most clearly in FIG. 5, an electrode 42 is located internally and centrally at the rear of firing chamber 14. Electrode 42 is supported at the front of a plug 44 which is composed of hard, wear resistant, non-conductive material, such as ceramic which is capable of withstanding the pressures of firing. which plug 44 serves to electrically isolate electrode 42 from firing chamber 14. Guide pin 45 extends from the rear of electrode 42 through openings in moveable support plates or magnets 47.

Figure 3:
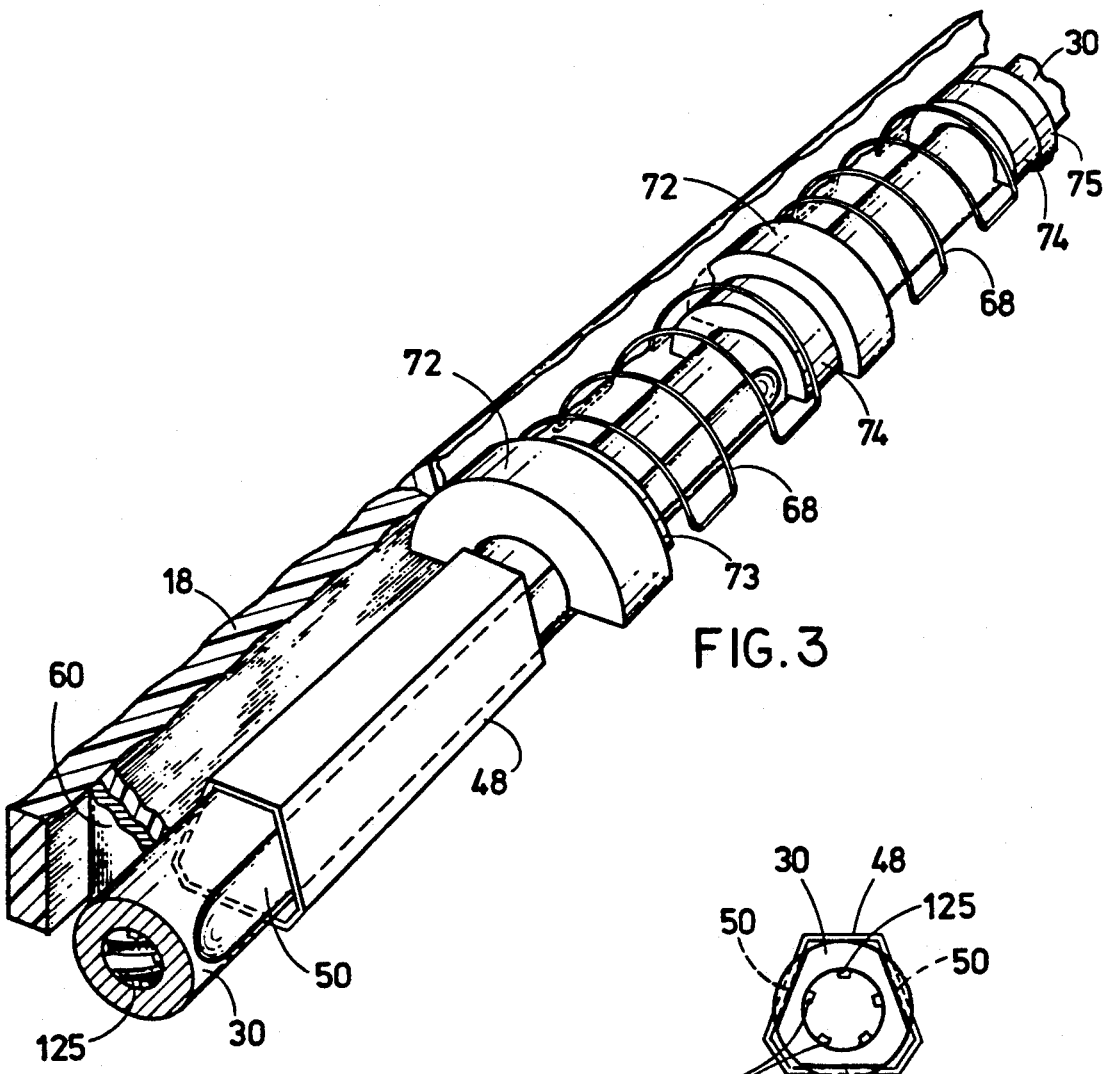
FIG. 3 is an enlarged perspective view, with parts broken away and partially in phantom showing additional details of the moveable barrel, the relationship between the barrel and one form of stationary guide system for the barrel, of the magnets carried by the barrel, and of the stationary magnets and field coils attached to the shroud of the firearm.
Figure 4:
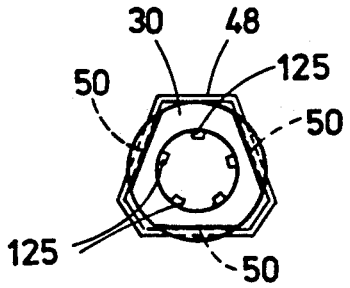
FIG. 4 is a front elevational view of the barrel and guide system shown in FIG. 3.
Figure 2:
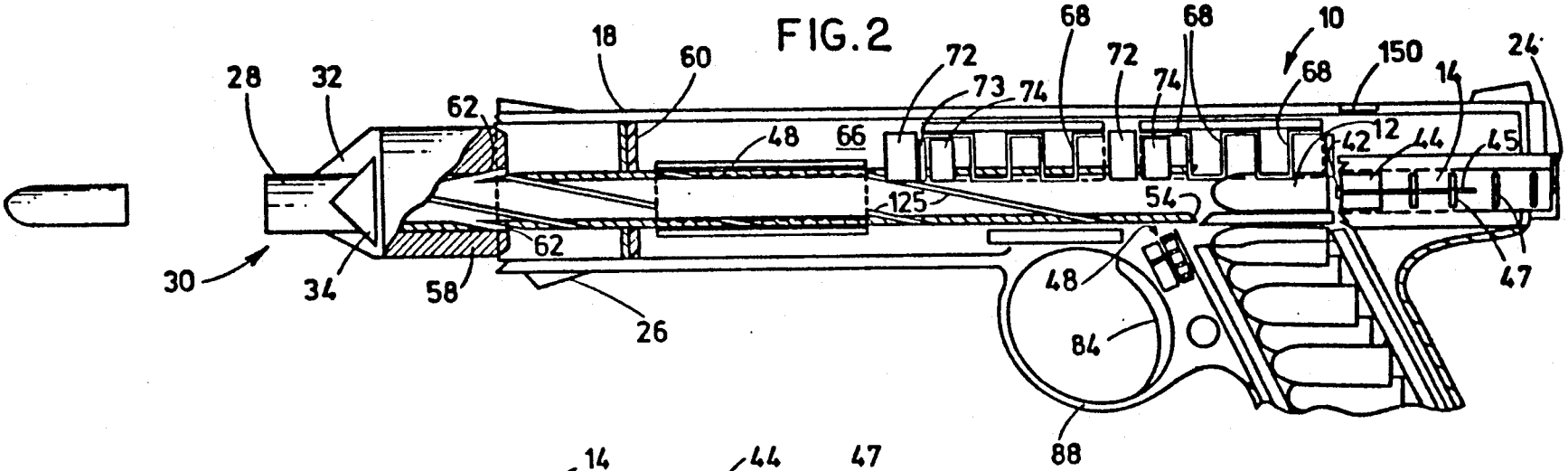
FIG. 2 is an elevational view, partially in cross-section and with parts broken away, similar to FIG. 1 just after it has been fired showing a projectile just exiting from the barrel, with the barrel and the magnets carried by the barrel in a forwardly extended recoil position caused by gas blow-by, and with a fresh projectile moving from the magazine towards the firing chamber, according to the present invention.

As shown in FIGS. 1 and 2 and detailed in FIGS. 3 and 4, a guide module 48 surrounds barrel 30. In preferred embodiments guide module 48 may be made of high density self lubricating nylon, oil impregnated bronze or brass mounted in aluminum or steel, composite materials such as KEVLAR/epoxy-graphite, hard anodized aluminum, or the like. Barrel 30 is tubular, and is mounted within shroud 16 for forward and backward movement within guide rail module 48. In the embodiment shown, barrel 30 carries a plurality of longitudinal slots or flats 50 which are received within and guided by stationary guide module 48 during the forward and rearward movement of barrel 30.

Moveable barrel 30 includes a front or muzzle end 28 and a rear end 54. Surrounding and connected to muzzle end 30 of barrel 30, but within shroud 16, is front end cap 58. Two or more gas ports 62 extend from the interior of barrel 30. Gas ports 62 are within front end cap 58. As shown in FIGS. 1 and 2, gas ports 62 are set at a rearwardly directed angle. Deflector plate 60 is mounted in shroud 16. Barrel 30 extends through deflector plate 60, without being attached to it, in a manner such that barrel 30 can slide up and back through deflector plate 60. Gas ports 62 normally abut deflector plate 60, as shown in FIG. 1. Upon the firing of a projectile 12, a portion of the expanding combustion gases pass backward through ports 62 and against deflector plate 60. The resulting gas pressure forces front end cap 58 and connected moveable tubular barrel 30 to be blown forward, as shown in FIG. 2, followed by a rearward movement, all within shroud 16. As illustrated, deflector plate 60 is composed of a composite of, for example, treated steel and plastic material. The steel portion of deflector plate 60 is positioned to receive the impact of the gases from ports 62 and resist erosion from those gases.

Referring to FIG. 1, it will be noted that the forward portion of firing chamber 14 is recessed in a manner which allows it to connect with and to accept rear end portion 54 of movable barrel 30 to form a gas tight seal. This allows firing chamber 14 and barrel 30 to separate from one another in response to the gas driven blow forward motion of barrel 30 during firing. It also allows firing chamber 14 and barrel 30 to reconnect with one another during the return movement of barrel 30 within shroud 16. In practice, the front end of firing chamber 14 and the rear end of barrel 30 will be of such a complimentary shape and fit with one another that, when they are juxtaposed, as in FIG. 1, they provide a gas tight seal of the type required to allow the firearm to operate efficiently when a projectile or cartridge is fired. In preferred embodiments both the firing chamber 14 and barrel 30 are constructed of strong wear resistant material. Internally and externally chrome plated high carbon 4440 steel is a non-limiting example, of such material.

Also enclosed within shroud 16 above and external to both barrel 30 and firing chamber 14 is a stationary chamber, generally 66. One or more stationary field coil 68 is located within stationary chamber 66. Each field coil 68 is in axial alignment with, but spaced from the centerline of barrel 30. Stationary magnets 72 are attached directly to right shroud 18 within stationary chamber 66 in close proximity to the front end of each field coil 68. The body and poles of each stationary magnet 72 is substantially axially aligned with its associated field coil 68, while also being axially aligned with but spaced from the centerline of barrel 30.

Magnets 74 are attached directly to the top of moveable barrel in close proximity to the rear end of each stationary field coil within stationary chamber 66. The body and poles of each magnet which is attached to the top of moveable barrel 30 are axially aligned with, but spaced from the centerline of barrel 30. Each magnet 74 which is carried by barrel 30 is located, positioned and sized in such a manner that it can and will move forward and then backward either through or in close proximity to its associated stationary field coil 68. When barrel 30 and attached magnets 74 move forward and then backward in proximity to their associated field coils 68 during firing and recoil, they generate an electric charge within each coil 68. As detailed below, this electric charge is transmitted by wires, not shown, for storage within the firearm (as detailed below) and is then available to initiate the electrical firing of projectiles 12. The charge thus generated is rectified, for example by a diode, so that the different charge generated by each direction of motion of magnets 74 through field coils 68 enters the storage unit with the same character.

The stationary magnets 72 carried by shroud 18 and the movable magnets 74 carried by barrel 30 are all preferably permanent magnets, although, in certain embodiments electromagnets may be used. While the stationary magnets 72 carried by shroud 18 and the movable magnets 74 carried by barrel 30 are all substantially aligned with one another and have their poles aligned, the polarity of magnets 72 is reversed with respect to the polarity of magnets 74. That is, if each stationary magnet 72 carried by shroud 16 has its front and rear poles aligned south to north, respectively, then each movable magnet 74 carried by barrel 30 has its front and rear poles aligned in the reverse order, that is north to south respectively. This will result in the north pole of each magnet 74 which is carried by barrel 30 being driven into proximity to the north pole of each magnet 72 which is secured to shroud 18 when barrel 30 is caused to blow forward during firing. However, since like magnetic poles repel each other, after each north pole of magnet 74 is brought into proximity to the north pole of each magnet 72, and after the gas pressure which caused the blow forward motion of barrel 30 is dissipated, the repulsion between the north pole of each magnet 72 which is fixed to shroud 16 and the opposed north pole of each magnet 74 carried by movable barrel 30, causes a magnetically induced recoil which serves to return magnets 74 and attached moveable barrel 30 rearward to its pre-firing position. Therefore, the need for operating springs to return the barrel to its pre-firing position after firing is eliminated. Forward stop 73 of nonconducting, non magnetic material is located to keep front most magnet 74 from making an impact with magnet 72 and to limit the forward movement of attached barrel 30. Rear stop 75 is located to keep rear most magnet 74 and attached barrel 30 from recoiling too far to the rear. Should it be desired to use operating springs to cause recoil, either alone or in combination with magnets 72 and 74, that is within the teaching of the present invention.

Now referring to FIG. 3, in preferred embodiments magnets 74 carried by movable barrel 30 are shown to be semi-torroidal, field coils 68 fixed to shroud 18 are shown to be semi-circular or crescent shaped to thereby define a substantially semi-cylindrical shaped open path which will allow semi-torroidal magnets 74 to pass through field coils 68 to generate an electric charge. Similarly, magnets 74 fixed to shroud 18 are also shown to be semi-torroidal, but larger than semi-torroidal magnets 72. As previously noted, magnets 72 and 74 are preferably permanent magnets which have been formed from art known metal, ceramic, rare earth, or other magnetic material by casting, molding, metal working or other conventional techniques. Additionally, magnets 72 and 74 may be substantially formed into their desired semi-torroidal shapes by placing a plurality of bar or strip magnets closely adjacent to one another on barrel 30 or in shroud 18. Similarly, other shapes of magnets 72 and 74 may be used in the practice of the present invention. Should it be desired to use electromagnets to provide the function of magnets 72 and 74, that is well within the state-of-the-art.

Now referring to FIG. 5, in which there is shown an enlarged side elavational view of the stationary firing chamber 14. An electrode 42 is located internally and centrally in the base of firing chamber 14 and is surrounded by a dielectric material 44, such as ceramic, which serves to electrically isolate electrode 42 from firing chamber 14. Electrode 42 is connected via connecting wire 78 to control assembly, generally 80 and trigger assembly 82. As shown in FIGS. 1 and 2, trigger assembly 82 is located similarly to and may have the appearance of a conventional counterpart weapon trigger. Trigger assembly 82 includes trigger 84 on pivot 86 within trigger guard 88. The tension of trigger 84 may be preset during production, for example at a nominal 3 pounds of activating pressure.

A charge storing device such as a capacitor, or a battery or other electric charge storing device 90 is located in proximity to trigger 84, and is in electrical series with control unit 80. Control unit 80 is linked by connecting wire 92 to a first switch element contact 94. Trigger 84 carries a second switch element contact 96 which is also linked by wire 97 to control unit 80. When trigger 84 moves to the rear on pivot 86 second switch element 96 makes contact with first switch element contact 94 to complete a circuit to control unit 80. Depending on the setting of control unit 80 this will cause either a single shot or a multiple burst of shots to be fired. A mechanically activated selective fire switch 98 is located at the rear of trigger guard 88. Switch 98 is preferably located on both sides of the weapon for ambidextrous use. By virtue of control unit 80, which may include a microprocessor, switch 98 can act as a safety and also as a selector for various firing sequence. For example, when switch 98 is in its uppermost position it places dielectric spacer 102 between first and second contacts 94 and 96, to thereby make it impossible to close the circuit, and effectively placing the weapon on safety. When switch 98 is moved, for example, one notch downward, as shown, the micro-processor of control unit 80 may make the weapon capable of operating as a semi-automatic weapon to fire single shots. When switch 98 is moved two notches downward the weapon may be set to a different firing regime, for example, the automatic firing of short bursts of shots, say three projectiles at a time. When the switch 98 is moved three notches downward, for example, the weapon may be set to yet a different firing regime, say fully automatic firing. The firing sequence is controlled by control unit 80 which, for example, includes a microprocessor. All circuits within the weapon are preferably produced of heavy duty circuit board encased, for example, in epoxy.

In any event, in each instance an igniting charge is transmitted to electrode 42 located in the rear of firing chamber 14. As previously detailed, charge storing device 90 is charged during each forward and backward movement of magnets 72 attached to barrel 30 through field coils. Control unit 80 includes, for example a rectifier, such as a diode, so that the different charges generated by each direction of motion of magnets 74 within field coils 68, always enter storage element 90 with the same character.

Now referring to FIG. 6, one form of projectile, generally 12 is shown in cross-section. As shown, projectile 12 has a hollow-base, a base end 112 formed of conductive material, and a propellant 114 in the hollow-base. A base seal 116 extends over propellent 114 at base end 112. Base seal 116 is typically comprised of burnable material, such as a thin wafer of nitrated paper which is coated on its outer surface with a material which enhances its conductivity, such as a collodion of nitrocellulose lacquer and aluminum dust, while the inner surface of the paper, which is in contact with propellent 114 is coated with material which enhances its flammability, such as KN03. When electricity is released from storing device 90 to electrode 42 located in the rear of firing chamber 14, electricity flows through the conductive material on the exterior of base seal 116 to the conductive material of base end 112, from whence it jumps to the conductive wall of firing chamber 14. This results in a spark which causes the ignition of propellant 114, thereby causing an explosion which causes the firing of projectile 12. Additional details concerning the preferred projectiles are described in greater detail in U.S. Pat. application Ser. No. 07/455754, filed simultaneously herewith.

Details of one preferred form of ammunition magazine, generally 120 is shown in FIG. 1. Magazine 120, as shown, is detachable from the body of weapon 10 in much the manner that state-of-the-art magazines are attached and detached to weapon wells. When magazine 120 is attached to the body of weapon 10 in the position shown in FIG. 1, the bottom of the barrel 30 blocks the mouth of magazine 120, thus keeping ammunition from entering firing chamber 14. The mouth or upper portion of the magazine has a pair of spaced apart lips, not shown, which are bent slightly inwardly to retain ammunition projectiles 12, which are shown double stacked, within magazine 120 when the magazine is not connected to the weapon. Projectiles 12 enter chamber 14 as a result of the magnetic or spring biasing pressure which is applied to follower 126, and thence to the bottom of the ammunition stack by which serves to urge projectiles 12 into the mouth of the magazine at the time of firing. This projectile feeding action is accomplished concomitantly with firing as a result of the gas blow forward action which moves the bottom of barrel 30 forward, out of blocking position to the mouth of the magazine. In operation, uppermost projectile 12 is then stripped by the rearward movement of the open rearmost lower portion of barrel 30 on recoil return. At that time, the nose of the uppermost projectile 12 in magazine 120 is engaged by rifling 125 in barrel 30 and is guided into firing chamber 14 for firing. Alignment mechanisms, not shown, of the type commonly used in the art are used to properly position projectile 12 in firing chamber 14. It is noted that magazine 120 can be sized to hold any standard number of rounds, say six, ten, twelve, or even twenty five or more, when alternately double stacked, as shown.

In the preferred embodiment of magazine 120, as shown in FIG. 1, follower 126 is magnetically actuated. The magnetic actuation is obtained by providing a series of opposed pole permanent magnets 128 within magazine 120, and on the bottom of follower 126. Magnets 128 have their top and bottom poles aligned, sequentially, south to north, and north to south, respectively. In this exemplary arrangement, the top south pole of one magnet 128 is adjacent to the bottom south pole of adjacent magnet 128. However, since like magnetic poles repel each other, the proximity of the south pole of bottom magnet 128 to the south pole of the adjacent magnet 128 causes a magnetically induced repulsion which serves to provide the necessary force to move the magnets 128 and moveable follower 126 and any projectiles 12 which are stacked above it upward, and when possible, to feed projectiles 12 one at a time into firing chamber 14. Therefore, the need for operating springs within magazine 120 to move follower 126 upward is eliminated. However, should it be desired to use operating springs in the magazine, either alone, or in combination with magnets 128, that is within the teaching of the present invention.

Loading of magazine 120 may be accomplished in substantially the same manner as a conventional magazine. However, magnetically powered magazine 120 can remain loaded for indefinite periods of time without the danger of the spring losing tension, corroding or failing in any other way. This allows the production of such magazines 120 which can be factory loaded, sealed, and stored for extended periods of time. Additionally, an alternate magazine for hundreds of rounds of the horizontal coil enclosed in a drum design type, not shown, and using opposing magnets set at intervals behind the follower, could also be provided.

As shown in FIG. 7, an alternative form of magazine, with a spring 132 located between the bottom of the magazine and follower 126 and any projectiles 12 which are above it upward, and when possible, to feed projectiles 12, which are shown double stacked, one at a time into firing chamber 14. It will be noted that a battery system 134 is located in the bottom of the magazine of FIG. 7. Such a battery system 134 may carry sufficient charge to provide for the ignition of all of the projectiles contained in the magazine. Battery 134 can be linked to control unit 80 by means of wire couple 138 by which it can serve to either replace the electricity generation features of the invention, as shown in FIGS. 1-3, and storage unit 90, as shown in FIG. 5, or as an auxiliary storage vessel for the energy generated by the systems shown in FIGS. 1 and 2.

The system may also be provided with a complete lock-up system, generally 150. Two forms of possible lock-up system 150 are contemplated, a physical key system or a key pad utilizing a code system. The location of the lock-up system 150, as shown, would most preferably be close to the rear of shroud 16, so that when the user holds the weapon in either hand the key or key-pad of lock-up system 150 can be operated by the other hand. The intent of such a lock-up system is to provide both a child-proof weapon, whether the weapon is loaded or not, and also to provide a soldier or a law enforcement officer a system that would ensure that his or her weapon could not easily be fired at him or her.

To activate weapon 10, a user simply inserts a loaded magazine 120 into the magazine well of the weapon, unlocks lock-up system 150, places his or her thumb on cocking knobs 34 located on either side of muzzle front end cap 32, to push barrel 30 forward to stop 73. The user then releases knobs 34 on muzzle end 28 and allows barrel 30 to retract under the power of either the repulsion between magnets 72 and 74, or springs (not shown), or a combination of the two. At this time, a projectile 12 will be stripped from the top of magazine 120 and moved into firing chamber 14. Upon the closing of the rear end 54 of barrel 30 with the front of stationary firing chamber 14, weapon 10 is now in the loaded position with projectile 12 seated in stationary firing chamber 14. As projectile 12 moves towards the rear of firing chamber 14, it contacts electrode 42 and ceramic block 44, and pushes them towards the rear of the weapon. As they are pushed, support plates 45 are also pushed towards the rear. The user then makes a determination as to what mode he or she cares to have the weapon in and sets switch 98 to the desired firing or safety position.

To unload the weapon, the user simply removes magazine 120 from the magazine well of the weapon, and cycles the action of the firearm by once again placing his or her thumb on the cocking knobs 34 located on either side of muzzle front end 28 and pushes barrel 30 forward until it engages stop 73. When barrel 30 is moved forward projectile 12 in firing chamber 14 is gripped at its nose by rifling 125 of barrel 30 and pulled forward from firing chamber 14. At the same time, if support plates 45 are magnets in opposed relationship, or spring loaded (not shown) they serve to propel electrode 42 and ceramic block 44 forward, which will also cause any projectile 12 which is in firing chamber 14 to be pushed forward. These combined actions allow any projectile 12 which was in firing chamber 14 to fall free of the firearm through the unoccupied magazine well. During firing sequences, this action also aids in the cleansing of firing chamber 14.

Since it is designed to receive a folding fore-grip and folding skeleton buttstock, either of which can be permanently attached to the weapon, the pistol like weapon shown in FIGS. 1 and 2 can be rigged for field or combat use. A detachable sling can be attached at points located near the top of the right side of the shroud near the front and the rear.

The mating perimeters of each half 18 and 22 of shroud 16 terminates in any of the well known opposing snap fit edges which, when closed and joined, provide a substantially fluid tight seal. Therefore, when the weapon is loaded and ready to fire with a magazine in the magazine well, the only portion of the internal parts of the weapon which is exposed to the elements is firing chamber 14 through cooling slots 38 in shroud 16, and the mouth of barrel 30. Shroud 16 is made of high impact, and preferably of corrosion resistant material, such as any of the art known polymers or metals.

The design of the present invention allows for quick, easy and efficient field stripping. Such field stripping can be accomplished by laying the weapon 10 on its right side 18, muzzle end 28 to the left. Catch 26 can be released near the muzzle front end shroud to allow left shroud 22 to be opened to the right. As shown in FIG. 1, all removable or replaceable parts are within right shroud 18 of firearm 10. Trigger assembly 82 is removable or replaceable. Field coils 68 are also removable or replaceable. Barrel 30 and its guide system 48 are individually replaceable. The firing chamber 14 and contained electrode 42 is replaceable as a unit. All circuits within the weapon are constructed of heavy duty circuit board encased in protective material, such as epoxy and are each replaceable as units.

It is thus seen that the present invention provides an electrically-fired firearm system, which can operate with or without batteries, which system has only one moving part. It also provides a firearm which uses magnets to generate the charges which are required to detonate the projectiles, which, by the use of opposing magnets, eliminates the need for the inclusion of recoil springs after firing, and which also uses magnets to dampen the recoil of the firearm, and by thus reducing recoil improves accuracy. It further provides such a firearm system which is capable of using cartridgeless ammunition, and which, by the use of cartridgeless ammunition, can eliminate substantial ammunition costs for the user. Additionally, it provides a firearm system, which, when loaded with a magazine and ready to fire, operates with no external openings with the exception of the muzzle and cooling slots surrounding the firing chamber. Since the preferred form of the firearm of the present invention need have no springs, has limited openings, and only one moving part, it can operate under almost any physical or climatic conditions. This includes submersion in water, or extended burial, the latter of which requires only the shaking or washing of dirt out of the weapon. Assuming construction of corrosion resistant materials, extreme climatic conditions, dirt and water will cause no substantial adverse effects to the weapon. It also provides a field weapon, which due to the elimination of the need for a heavy operating bolt and/or slide, of the type which is common to contemporary field weapon designs, achieves great reduction in overall weight of the weapon, thereby making it easier to carry and easier to operate, and which thereby also offers a great reduction in the amount of recoil felt by the user, and by thus reducing recoil improves accuracy. The weapon of the present invention is also designed to utilize a forward motion of its barrel on firing, which further reduces the amount of recoil felt by the user, and assists in improving accuracy. It will be further seen that the weapon system of the present invention is simple in construction, design and operation, thereby providing a great reduction in production costs and in training requirements, even for operators having no firearm experience. Because of its simplicity of design, the firearm system offers a simple weapon which is inexpensive and cost effective to produce, and which has components which are both easy to clean or replace, and for which replacement parts are low in cost. The materials selected for the construction of the components of the present invention shall not be considered to be a limitation on the invention as taught or claimed.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A firearm comprising:

(a) a tubular barrel having an inside, an outside, a bore end, a middle and a rear end, said middle having a plurality of slots;

(b) at least one port, said at least one port being located integral to said tubular barrel whereby expanding gases resulting from the firing of projectile propellant pass through said at least one port and force said tubular barrel to move forward;

(c) a firing chamber, said firing chamber being stationary and enclosed, whereby said firing chamber can be loaded automatically;

(d) a means for attaching said firing chamber to said rear end of said tubular barrel, said attachment means being capable of allowing said firing chamber and said barrel to separate from each other and reattach upon recoil of the firearm;

(e) a plurality of field coils located within said firing chamber;

(f) a magazine having an inside and an outside, said magazine connected to said tubular barrel and said firing chamber.

(g) a plurality of magazine magnets, said magazine magnets being securably located within said magazine whereby said magazine magnets supply the necessary force to feed projectiles into the breech of the firearm;

(h) a trigger assembly having a trigger switch, a safety switch, a control unit and a capacitor, said trigger assembly being securely attached to said firing chamber;

(i) a means for electrically igniting the projectile propellant, said igniting means creating an electrical energy to ignite a projectile propellant through the use of a combustible priming wafer, said electrical energy being released from said capacitor upon the pulling of said trigger switch causing the closing of a circuit.

2. The firearm as disclosed in claim 1 wherein said igniting means comprises a plurality of magnets releasably attached to said barrel whereby said magnets are allowed to move along said barrel in close proximity to said field coils.

3. The firearm as disclosed in claim 1 wherein said attachment means comprises a plurality of magnets, whereby said magnets resist separation of said tubular barrel and said firing chamber until the resulting gas expansion of a conventionally fired projectile enters said ports after the passage of the projectile through said tubular barrel.

4. The firearm as disclosed in claim 1 wherein said firing chamber is enclosed within a chrome plating.

5. The firearm as disclosed in claim 1 wherein said firing chamber comprises an electrode, said electrode being encased by a ceramic insulation.

6. The firearm as disclosed in claim 1 wherein said inside of said magazine is comprised of high density nylon.

7. The firearm as disclosed in claim 1 wherein said outside of said magazine is comprised of high impact plastic.

8. The firearm as disclosed in claim 1 wherein said computer chip of said trigger assembly comprises a safe mode whereby the firearm will not function, a semi mode whereby the weapon shall fire one shot per pull of trigger, a three mode whereby the weapon shall fire three shots fully automatically in a burst per each pull of the trigger, and a full mode whereby the weapon shall fire fully automatically during the time that the trigger is held back or until the magazine is emptied.

9. The firearm as disclosed in claim 1 wherein said inside of said inside of said tubular barrel comprises a plurality of guide rails.

10. The firearm as disclosed in claim 9 wherein said guide rails are comprised of high density nylon.

11. The firearm as disclosed in claim 1 wherein said magazine is adapted to hold approximately 200 rounds of projectile ammunition.

12. The firearm as disclosed in claim 11 wherein said magazine is detachably connected to the firearm.

* * * * *